United States Patent [19]

Thomas

[11] 4,361,263

[45] Nov. 30, 1982

[54] EGG TRAY

[75] Inventor: Leslie P. Thomas, Canton, Mich.

[73] Assignee: Diamond International Corporation, New York, N.Y.

[21] Appl. No.: 181,975

[22] Filed: Aug. 28, 1980

[51] Int. Cl.[3] ..... B65D 1/00

[52] U.S. Cl. ..... 229/2.5 EC

[58] Field of Search ..... 229/2.5 EC, 44 EC, 45 EC; 206/518, 519, 520; 217/26.5

[56] References Cited

U.S. PATENT DOCUMENTS

| | | | |
|---|---|---|---|
| 1,813,810 | 7/1931 | McDonald et al. | 206/519 |
| 2,844,268 | 7/1958 | Lambert | 217/26.5 |
| 2,997,196 | 8/1961 | Emery | 217/26.5 |
| 3,120,901 | 2/1964 | Boyd | 217/26.5 |
| 3,195,770 | 7/1965 | Robertson | 220/23.6 |
| 3,258,155 | 6/1966 | Peppler | 221/36 |
| 3,275,189 | 9/1966 | Goldsborough et al. | 221/36 |
| 3,322,301 | 5/1967 | Bliss | 221/1 |
| 3,425,382 | 2/1969 | Johnson | 206/519 |
| 3,478,924 | 11/1969 | Comstock | 221/213 |
| 4,205,777 | 6/1980 | Brown et al. | 229/44 EC |

FOREIGN PATENT DOCUMENTS

| | | | |
|---|---|---|---|
| 1044009 | 11/1953 | France | 206/519 |

*Primary Examiner*—Herbert F. Ross

*Attorney, Agent, or Firm*—Kenyon & Kenyon

[57] ABSTRACT

A denestable plastic egg tray formed of a substantially flat sheet of material and having a plurality of alternate rows of pockets and posts for housing the eggs. A row of downwardly extending pockets is provided adjacent the parallel sides of the peripheral rim, each of the pockets including inclined outer walls. At least one ledge member is provided on the inclined pocket walls suitable to be engaged by a denesting finger during removal of the tray from the remainder of the stack of similar trays.

4 Claims, 7 Drawing Figures

Fig. 2.
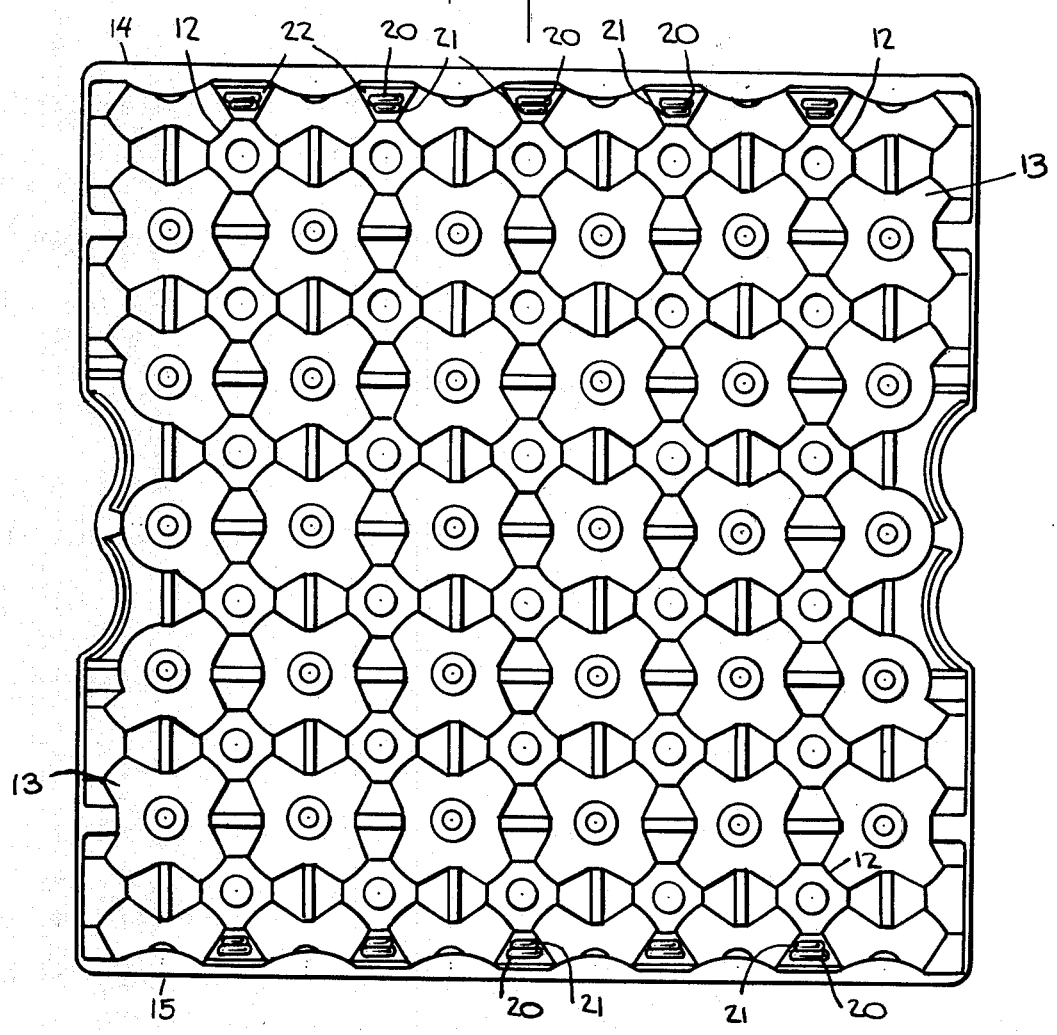
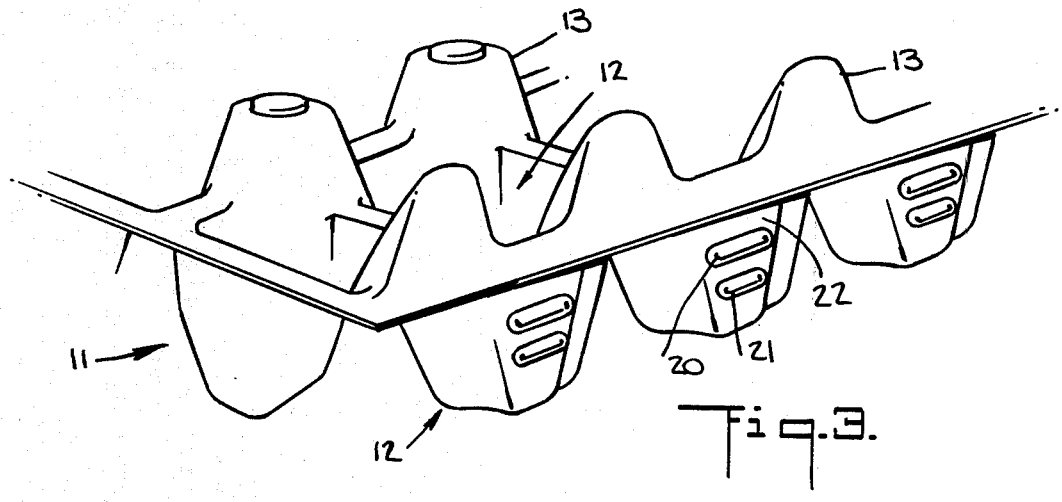
Fig. 3.

EGG TRAY

BACKGROUND OF THE INVENTION

This invention relates generally to egg trays and in particular to denestable plastic egg trays adapted for removal of the tray from a stack of similar trays.

Egg trays of various designs are known in the art and generally include a plurality of rows of pockets in which the eggs are housed, the pockets being separated by alternate rows of posts. One commonly used tray of this type houses 30 eggs and includes six rows, each including five pockets. This type of tray is generally known as a 6×5 tray. Such trays are generally provided in stacks which during processing requires that a single tray be removed from the bottom of a stack of identical trays. Removal of a tray in this manner generally entails the grasping of the lowermost tray by means of a denesting finger which in turn pulls the tray away from the remainder of the stack. When the trays are snugly stacked upon one another, problems frequently occur during denesting, generally for any of two reasons. One involves the lack of a gripping ability by the denesting mechanism engaging the tray while the other occurs because the tray is too snugly stacked with respect to the adjacent tray. Failure to remove a tray causes mechanical jamming of the denesting apparatus necessitating either manual operator intervention or machine shut down. By the means disclosed herein, an egg tray is provided which may readily be removed from the remaining stack of trays without any denesting problems which would cause an interruption of service.

SUMMARY OF THE INVENTION

Briefly stated this invention relates to a plastic egg tray formed from a substantially flat sheet of material which is defined by a peripheral rim having two parallel sides. The plastic tray includes a plurality of alternate rows of pockets and posts extending from the plane of the sheet, the rows of pockets extending downwardly from the plane of the sheet while the rows of posts extend upwardly from the plane of the sheet. The tray includes downwardly extending pockets adjacent each of the parallel sides of the peripheral rim with the pockets including inclined side wall portions depending inwardly from the rim edge. A ledge member is included in the inclined wall of a plurality of the pockets adjacent the parallel sides and includes a surface suitable to be engaged by a denesting finger during removal of the individual tray from the bottom of the stack of similar trays.

The ledge member preferably extends outwardly from the inclined wall of the pockets and includes an upper surface suitable to be engaged by the denesting finger during removal of the individual tray from the bottom of the stack. A pair of ledge members may be provided in order to insure engagement by the denesting finger in the event that a secure engagement is not made in the first instance with the uppermost ledge member. The ledge member preferably extends outwardly from the inclined wall at least approximately 0.030 inches, the preferred range being 0.030 to 0.040 inches.

In practising the method of the invention, a stack of trays is provided each of which includes a ledge member on the inclined wall of the pockets disposed adjacent the parallel sides of the periphery of the tray. A plurality of denesting fingers located on opposite sides of the parallel walls of the tray are moved toward the inclined wall including the ledge member thereon. The denesting fingers engage the upper portion of the ledge member in order to effect removal or loosening of the tray from the remaining stack. Once so engaged, the denesting finger is moved downwardly and away from the stack of trays while the finger is in engagement with the upper portion of the ledge member to effect removal of the engaged tray from the remaining stack of trays.

Accordingly, it is an object of this invention to provide an egg tray which is adapted to be readily removed from a remaining stack of similar trays.

It is another object of this invention to provide a plastic egg tray which includes ledge members on the outer surface of the pockets along a pair of parallel walls by which the trays may be gripped and removed from the remaining stack of trays.

It is still another object of this invention to provide a method of positively removing egg trays from the remaining stack of similar trays.

These and other objects, advantages and features of the invention will become more apparent from the following description taken in accordance with the accompanying drawings.

BRIEF DESCRIPTION OF THE DRAWINGS

FIG. 2 is a bottom view of the egg tray of this invention;

FIG. 3 is an exploded fragmentary, perspective view of the corner of the egg tray of this invention;

DESCRIPTION OF THE PREFERRED EMBODIMENT

Figure 1:
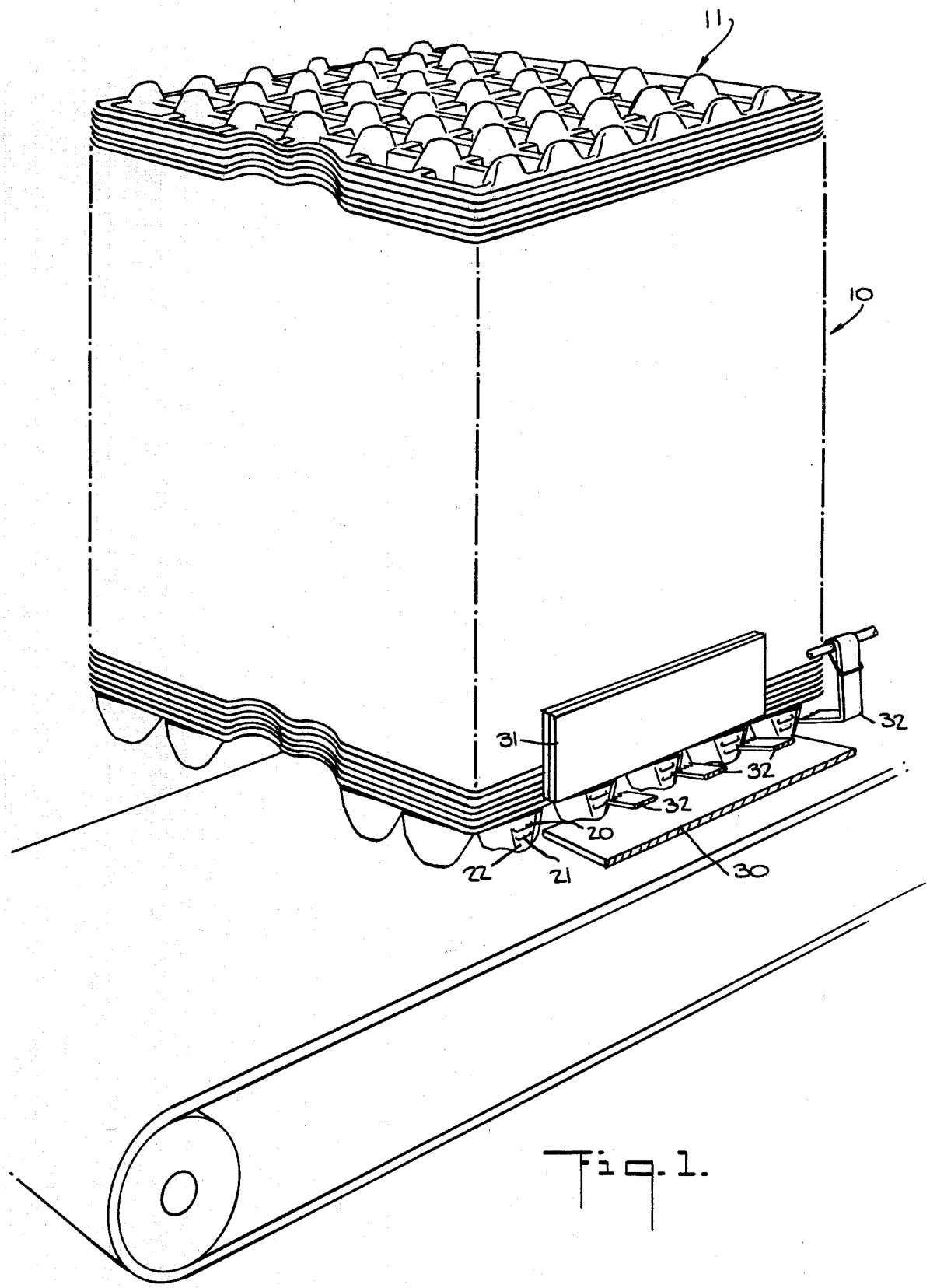
FIG. 1 is a perspective view of a stack of trays disposed above a denesting mechanism.

With reference to the drawings and particularly FIG. 1, there is depicted a stack of trays 10 which includes a plurality of identical plastic egg trays 11 stacked one upon the other. An individual tray 11 is depicted in a bottom view in FIG. 2 and includes a plurality of pockets 12 and alternate rows of posts 13. The arrangement thus forms a 6×5 tray suitable for housing 30 eggs. The tray is formed of a plastic material which may include polyethylene, polypropylene and other similar materials. The 6×5 tray is generally square in shape and includes five pocket members 12 disposed adjacent the upper and lower edges, 14 and 15, of the tray. Each of these five pocket members 12 includes a ledge member 20. In the preferred embodiment, a pair of ledge members 20 and 21 are included on each of the inclined walls 22 of the pockets 12 (FIG. 3). It is noted further that additional ledge members may be provided to include additional gripping surfaces.

Each ledge member 20 and 21 is disposed along the approximate centerline of the inclined wall 22 of the pocket 12. Ledge member 20 is disposed above ledge member 21 and is adapted to be engaged by a denesting finger in order to assist in the removal of a tray from the remaining stack of trays. In addition, ledge members 20 and 21 serve to prevent attachment or jamming of the adjacent trays when stacked. Each ledge is formed with a sharp upper crest portion suitable for engagement by the knife like denesting finger. It has been found that the ledge member best functions when the outer surface thereof extends from wall 22 a distance of at least 0.030 inches and preferably is between 0.030 and 0.040 inches. It is further noted that in certain instances, an inwardly extending ledge member may be provided.

Figure 4:
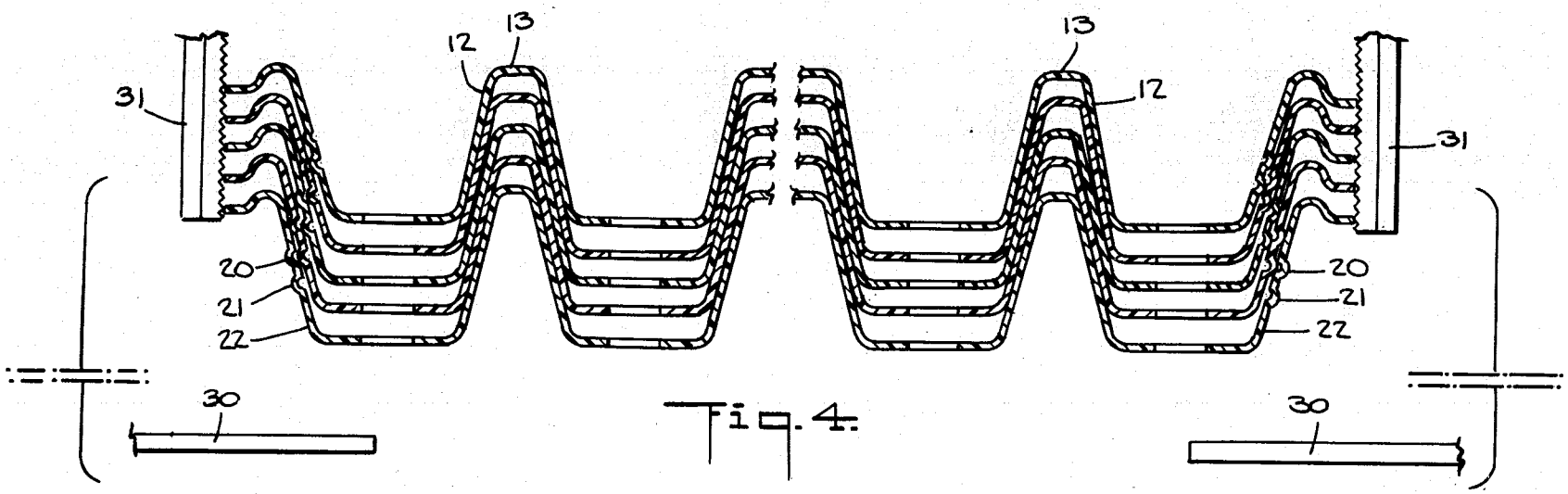
FIG. 4 is a side elevation view of a stack of egg trays being held above the platform.
Figure 5:
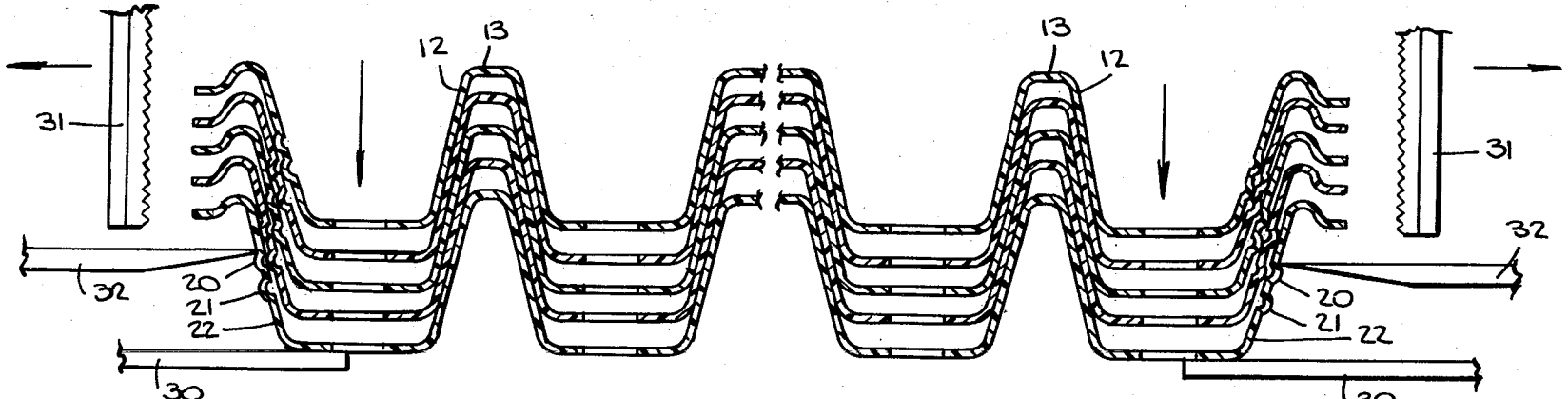
FIG. 5 is a side elevation view of a stack of egg trays being disposed on the platform.
Figure 6:
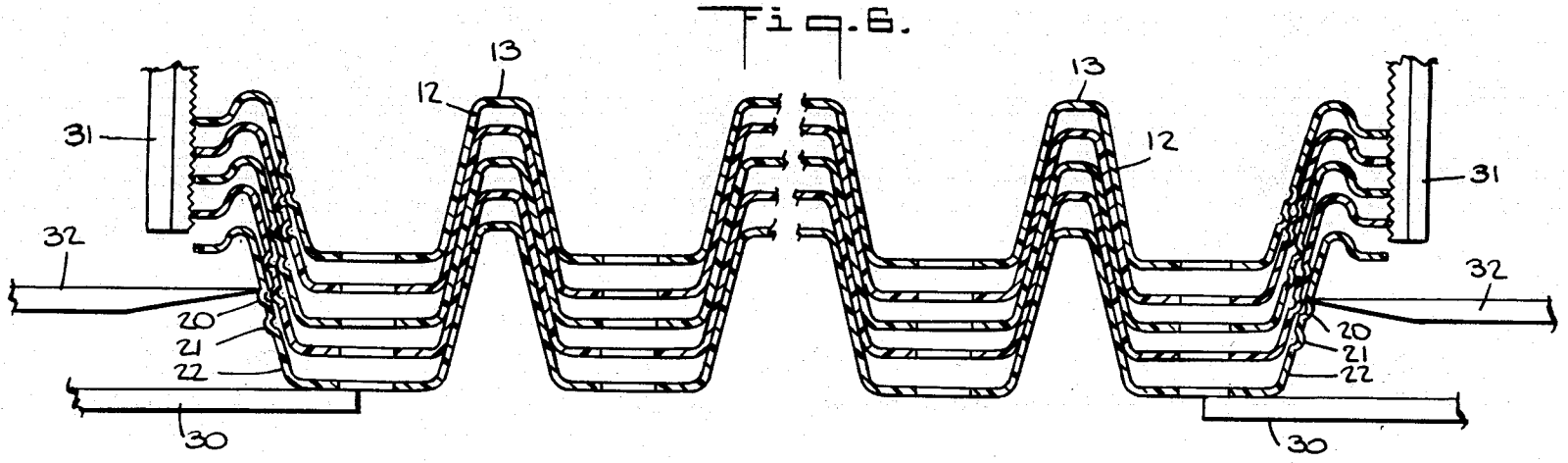
FIG. 6 is a side elevation view of a stack of egg trays being engaged by the denesting finger.
Figure 7:
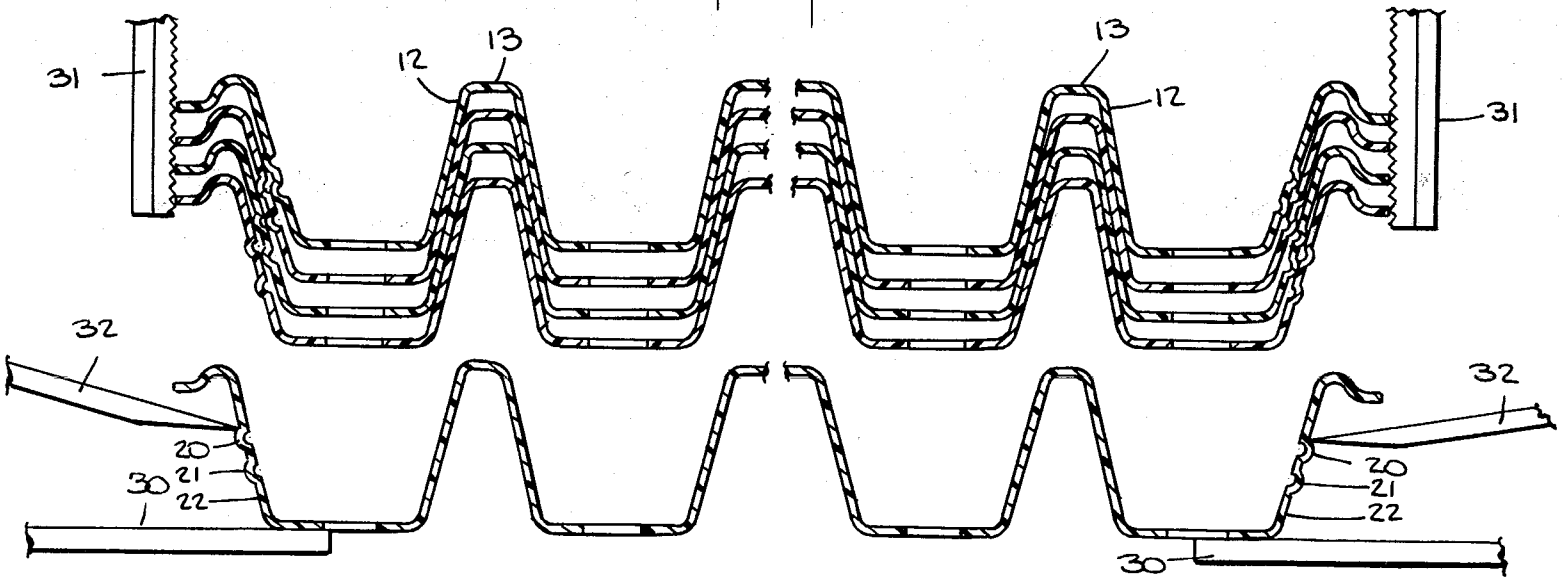
FIG. 7 is a side elevation view of the lowermost tray having been removed from the stack.

In utilizing the egg trays of this invention, they are provided in a stack 10 on a denesting apparatus such that the lowermost tray may be removed. With particular reference to FIG. 4, the stack of trays is supported by a platform 30 and gripper member 31 in a manner as follows. The gripper member 31 engages a group of trays disposed above platform 30 which is adapted to move up into engagement with the lowermost tray. The stack as illustrated in FIG. 4 is being held by the gripper member 31 a distance above platform 30 sufficient that a released tray 11 may be positioned free from the stack 10. In this respect, platform 30 is raised into engagement with the lowermost tray while gripper member 31 is pulled away from and releases the stack of trays 10 (FIG. 5). A denesting finger 32 moves in conjunction with the platform and engages the upper portion of ledge 20. Denesting finger 32 is knife shaped and swings upward along the surface of the inclined wall 22 of pocket 12. Downward movement of denesting finger 32 and platform 30 facilitates the removal of the lowermost tray from the remainder of the stack end gripper member 31 (FIG. 7). As previously mentioned, two ledge members 20 and 21 are provided so that a secondary ledge may be engaged in those instances where slippage over the first of the ledge members occurs. Although this situation is infrequent, the plastic surface of the inclined pocket wall is relatively low in friction and is difficult to grasp.

In normal operation, denesting finger 32 engages the upper portion of ledge member 20 at the sharp edge existing between the ledge member 20 and inclined wall 22. This engagement facilitates the removal of the lowermost tray 11 from the remaining stack 10 with the removed tray being supported on platform 30. Disposal of the removed tray is facilitated by a pusher member (not shown) which slides the tray off the platform and onto the belt illustrated in FIG. 1.

By the means disclosed herein an egg tray is provided which facilitates ready denesting from a stack of remaining similar trays. The means provided function to permit easy grasping of a plastic egg tray which has a relatively low friction surface and is otherwise difficult to grasp. Similarly, the means disclosed herein avoids tight nesting of the stack of trays which is a particular problem associated with plastic egg trays.

Although the above description is directed to the preferred embodiment of the invention, it is noted that other variations and modifications will be apparent to those skilled in the art, and may be made without departing from the spirit and scope of the present disclosure.

What is claimed is:

1. A plastic egg tray comprising a substantially flat sheet of material defined by a peripheral rim having parallel sides and including a plurality of alternate rows of pockets and posts extending from the plane of said sheet, said alternate rows of pockets extending downwardly from the plane of said sheet and said alternate rows of posts extending upwardly from the plane of said sheet, a row of downwardly extending pockets adjacent each of said parallel sides of said peripheral rim including inclined said wall members depending inwardly from said rim, and at least a pair of ledge members included in said inclined wall of a plurality of said pockets on each of said parallel sides and which includes a surface thereof suitable to be engaged by a denesting finger during removal of an individual tray from the bottom of a stack of similar trays, said ledge members being disposed closely adjacent one another on the approximate centerline of the inclined wall thereof to insure engagement of one of said ledge members with said denesting finger.

2. A plastic egg tray comprising a substantially flat sheet of material defined by a peripheral rim having parallel sides and including a plurality of alternate rows of pockets and posts extending from the plane of said sheet, said alternate rows of pockets extending downwardly from the plane of said sheet and said alternate rows of posts extending upwardly from the plane of said sheet, a row of downwardly extending pockets adjacent each of said parallel sides of said peripheral rim including inclined side wall members depending inwardly from said rim, and at least a pair of ledge members extending outwardly from said inclined wall of a plurality of said pockets, said ledge member extending outwardly of said inclined wall at least approximately 0.030 inches and including a portion of the upper surface thereof suitable to be engaged by a denesting finger during removal of an individual tray from the bottom of a stack of similar trays, each said ledge member being formed with a sharp upper crest portion meeting said inclined wall member and forming a sharp gripping edge to insure engagement of one of said denesting finger.

3. A method of denesting plastic egg trays from a stack of similar trays wherein each of said egg trays includes a substantially flat sheet of material defined by a peripheral rim having parallel sides and including a plurality of alternate rows of pockets and posts extending from the plane of said sheet, said alternate rows of pockets extending downwardly from the plane of said sheet and said alternate rows of posts extending upwardly from the plane of said sheet, a row of downwardly extending pockets adjacent each of said parallel sides of said peripheral rim including inclined side wall members depending inwardly from said rim, and at least a pair of ledge members disposed adjacent one another on the approximate centerline of the inclined wall of a plurality of said pockets on each of said parallel sides which comprises the steps of moving a plurality of denesting fingers located on opposite sides of the parallel walls of said tray inwardly toward the inclined walls having said ledge members thereon, engaging said denesting fingers with the upper portion of the upper of said ledge members, providing a second ledge member sufficiently close to said upper ledge member to insure engagement of said denesting finger with one of said ledge members, and moving said denesting finger downward and away from said stack of trays while said finger is in engagement with the upper portion of one of said ledge members to effect removal of the engaged tray from the remaining stack of trays.

4. The method of claim 3 wherein the upper portion of each of said ledge members meets the respective inclined wall member and forms a sharp gripping edge and each denesting finger is in the form of a knife edge suitable for engagement at said sharp gripping edge.

* * * * *